US009078496B2

(12) United States Patent
Vasilatos et al.

(10) Patent No.: US 9,078,496 B2
(45) Date of Patent: Jul. 14, 2015

(54) MOBILITY ASSISTIVE DEVICE

(71) Applicants: Jerry A. Vasilatos, Chicago, IL (US); Anastasios J. Vasilatos, Wilmette, IL (US)

(72) Inventors: Jerry A. Vasilatos, Chicago, IL (US); Anastasios J. Vasilatos, Wilmette, IL (US)

( * ) Notice: Subject to any disclaimer, the term of this patent is extended or adjusted under 35 U.S.C. 154(b) by 0 days.

(21) Appl. No.: 14/223,753

(22) Filed: Mar. 24, 2014

(65) Prior Publication Data

US 2014/0202508 A1 Jul. 24, 2014

Related U.S. Application Data

(63) Continuation-in-part of application No. 13/304,613, filed on Nov. 25, 2011, now Pat. No. 8,678,021.

(60) Provisional application No. 61/417,276, filed on Nov. 25, 2010.

(51) Int. Cl.
*A45B 9/04* (2006.01)
*A61H 3/02* (2006.01)

(52) U.S. Cl.
CPC ..... *A45B 9/04* (2013.01); *A61H 3/0288* (2013.01)

(58) Field of Classification Search
CPC ..... A45B 9/04; A61H 3/0288; A47B 91/04; A47B 91/06; A47B 91/12
USPC ..... 135/77, 82, 84, 86; 16/42 T, 42 R
See application file for complete search history.

(56) References Cited

U.S. PATENT DOCUMENTS

| | | | | | |
|---|---|---|---|---|---|
| 4,972,642 | A | * | 11/1990 | Strobl, Jr. | 52/297 |
| 5,363,618 | A | * | 11/1994 | Underwood | 52/301 |
| 5,755,644 | A | * | 5/1998 | Breems | 482/67 |
| D404,345 | S | * | 1/1999 | Donets | D12/130 |
| D426,495 | S | * | 6/2000 | Vaccaro | D12/133 |
| 6,131,593 | A | * | 10/2000 | Greene et al. | 135/77 |
| D433,354 | S | * | 11/2000 | Donets | D12/133 |
| 2009/0235966 | A1 | * | 9/2009 | Birnbaum | 135/66 |

* cited by examiner

*Primary Examiner* — David R Dunn
*Assistant Examiner* — Danielle Jackson
(74) *Attorney, Agent, or Firm* — Cardinal Law Group

(57) ABSTRACT

There is provided a tip configured for removable attachment to a walking aid device. The tip includes a base member, a shaft, and a plurality of spaced apart ribs. The shaft includes a bore therein extending upwards from a central portion of an inner surface of the base member to accept a distal end of a walking aid device. The plurality of spaced apart ribs extends from an outer rim of the base member to the shaft.

12 Claims, 3 Drawing Sheets

MOBILITY ASSISTIVE DEVICE

CROSS REFERENCE TO RELATED APPLICATIONS

This application is a continuation in part of and claims the benefit of U.S. patent application Ser. No. 13/304,613 filed Nov. 25, 2011, entitled MOBILITY ASSISTIVE DEVICE, which claims the benefit of U.S. Provisional Application No. 61/417,276 filed on Nov. 25, 2010, both of which are incorporated by reference in their entirety herein.

FIELD OF THE INVENTION

The present invention relates to tips for improving the stability and performance of ambulatory or walking aids.

BACKGROUND OF THE INVENTION

Tips for the distal ends of legs of walking or ambulatory aids, such as crutches, walkers or canes are traditionally used to provide support as the user moves forward or backwards. The tips are generally formed from solid rubber, with a flat base. Some tips have a rounded base, which may provide more comfort during the user's gait. Eventually, however, the tips crack and wear down. They must be replaced on a regular basis.

There have been a number of attempts to reconcile the shortcomings of traditional walking aid tips. Some tips have a wider base to provide more support, but end up being quite difficult to attach to the end of a mobility medical device. A number of these tips also only provide support in the middle of the gait when the mobility medical device is perpendicular to the surface of the ground. The tips that provide support for a wider range of the gait are bulky.

Also, a number of the tips in the prior art do not provide much support in loose surfaces, such as sand or gravel or stones. A great deal of effort may be required to walk across loose surfaces with a walking aid because the tips of walking aids tend to have a small surface area and they tend to sink through the loose surface.

SUMMARY OF THE INVENTION

In accordance with an aspect of the present invention, a tip configured for removable attachment to a walking aid device is provided. The novel walking aid tip comprises a base member comprising an inner surface, a shaft having a bore therein extending upward from a central portion of the inner surface of the base member, and a plurality of spaced apart ribs extending from the outer rim of the base member to the support member. Advantageously, the ribs are configured to flex in response to a downward compressive force on the shaft such that the tip is able to provide stability in a plurality of different directions and on a plurality of different surfaces. The downward compressive force would typically be applied by the user of the walking aid device and/or the weight of walking aid device as the user directs his or her weight onto the walking aid device and/or the weight of the walking aid device, a distal end of which is typically inserted into the bore of the tip's shaft. In this way, the force that causes the ribs to flex is also typically directed at an angle normal to the plurality of spaced apart ribs.

BRIEF DESCRIPTION OF THE DRAWINGS

The invention is explained in the following description in view of the drawings that show.

DETAILED DESCRIPTION OF THE INVENTION

Figure 1:
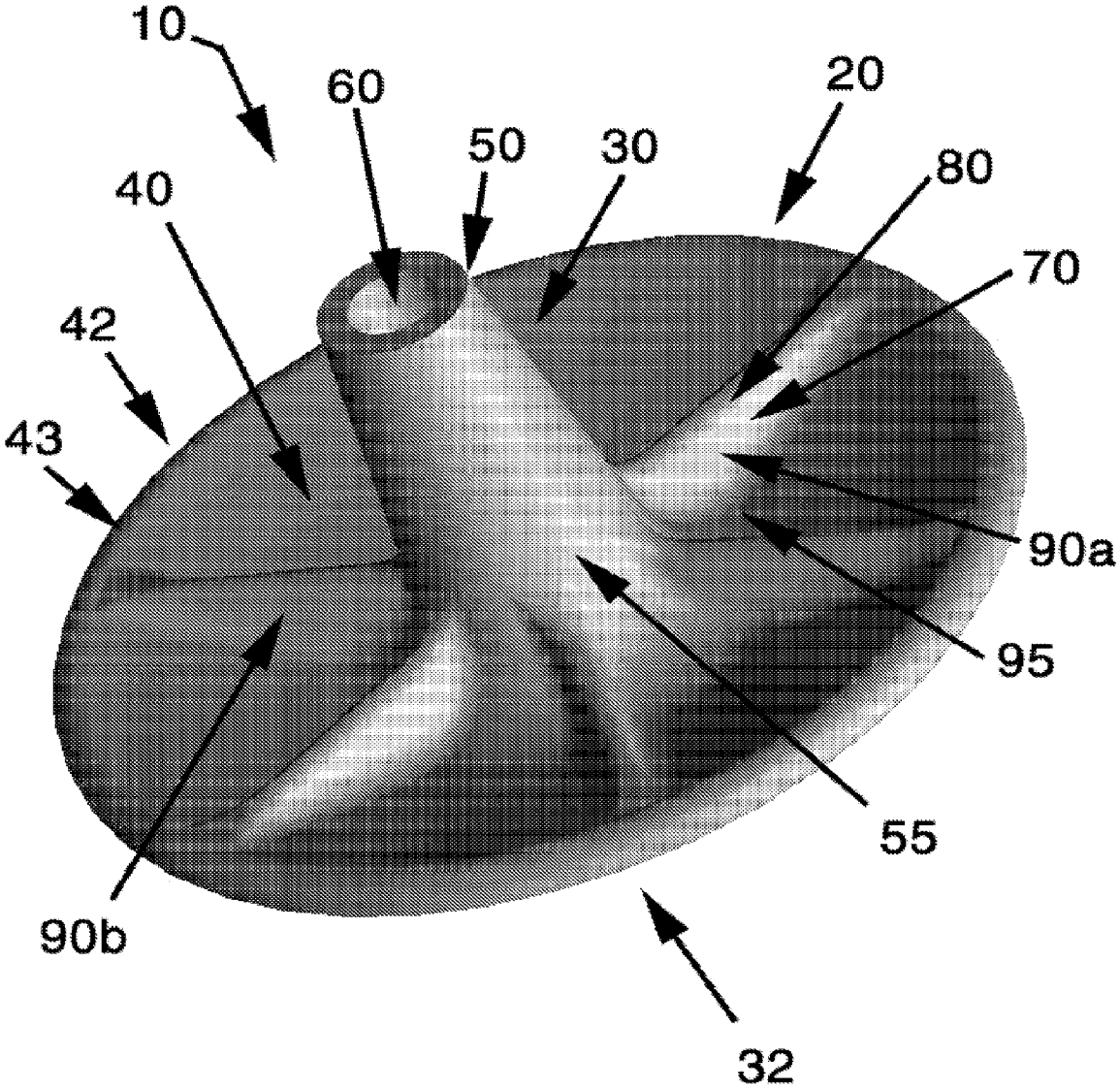
FIG. 1 is a top perspective view an embodiment of a tip in accordance with an aspect of the present invention.

Now referring to the figures, FIG. 1 illustrates a top perspective view of one embodiment of the present invention. A tip 10 for removable attachment to a walking or ambulatory aid (crutch, cane, walker, or the like) is shown as comprising a base member 20, a shaft 30, and a plurality of spaced apart ribs 70 extending from the base member 20 to the shaft 30.

In the embodiment shown, the base member 20 comprises an outer surface 32 having a convex shape, an inner surface 40 having a corresponding concave shape, and an outer rim 42 having a rounded edge 43. The plurality of spaced apart ribs 70 are configured to flex in response to a downward compressive force on the shaft 30 (typically from the walking aid and/or the user) and thus provide stability to the tip in a plurality of different directions and on different surfaces. Further, in the embodiment shown, the base member 20 has a circular shape. It is understood that the present invention is not so limited, however, and that the base member 20 may alternatively be any other suitable non-circular shape.

The shaft 30 extends upward from a central portion of the inner surface 40 of the base member 20 and comprises a top end 50, a bottom end 55, and a bore 60. The bore 60 is sized and shaped to accept a distal end or shaft of a walking aid device such as a crutch therein. If desired, set screws or a suitable locking mechanism may be used to facilitate the mating of the tip 10 and the distal end of the walking aid. However, one aspect of the present invention eliminates the need for set screws or the like due to the presence of the plurality of spaced apart ribs 70. In one embodiment, an outer diameter of the shaft 30 increases from the top end 50 to the bottom end 55 where the bottom end 55 intersects with the inner surface 40 of the base member 20. The shaft 30 of the tip 10 may be any length suitable to support the shaft of a mobility device, such as a crutch or cane during the entire gait of the user. In one embodiment, the intersection between the bottom end 55 of the shaft 30 and the inner surface 40 of the base member 20 is contoured in shape to prevent tearing and lengthen the life and durability of the tip 10. Further, in the illustrated embodiment, the tip 10 is formed as one continuous piece. In other embodiments, however, the tip 10 may comprise two or more separate pieces that are interconnected or interlocked with one another by a frictional fit or any suitable fastening or interlocking structures known in the art.

The plurality of spaced apart ribs 70 extend radially from the outer rim 42 of the base member 20 to the shaft 30. Each rib 70 comprises a top side 80, sides 90*a* and 90*b*, as well as a bottom side 95. In one embodiment, the top side 80 of each rib 70 lies on the same horizontal plane as a top edge of the outer rim 42 of the base member 20. In this way, the ribs 70 are able to provide a high degree of stability and reinforcement to the tip 10 and the device to which the tip 10 is attached regardless of the surface or direction of movement of the individual.

The ribs 70 may be any suitable length and width to allow the ribs 70 to flex in response to a downward compressive force on the shaft 30. In the embodiment shown, the bottom side 95 of each rib 70 is configured to follow the contour of the inner surface 40 of the base member 20 and are configured to flow seamlessly into the inner surface of the base member 20.

In other embodiments, the top side 80 comprises a distal end, a middle portion and a proximal end. The distal end is curved to meet the shaft 30 and increases in width from the middle portion to the shaft 30. The middle portion is relatively straight (lies in a horizontal plane). The distal end may rise above horizontal plane. The proximal end may have a beveled shape. In other embodiments, the proximal end increases in width from the middle portion to the base member 20. In other embodiments, the distal end may be relatively straight (lies in a horizontal plane). In other embodiments as well, the proximal end is of the same width as the middle portion.

Advantageously, the ribs 70 are configured to flex in response to a downward compressive force on the shaft 30 such that the tip 10 is able to provide stability in a plurality of different directions and on a plurality of different surfaces. The downward compressive force would typically be applied by the user of the walking aid as the user directs his or her weight onto the walking aid device, a distal end of which is typically inserted into the bore 60 of the tip's shaft 30. In this way, the force that causes the ribs 70 to flex is also typically directed at an angle normal to the plurality of spaced apart ribs 70.

In yet another embodiment, one or more of the base member 20, support member 30, and the plurality of spaced apart ribs 70 comprising the tip 10 is made of a material that has a degree of flexibility, such as a rubber, polyurethane, urethane, elastomer, or any material suitable to provide a degree of flexibility to the tip 10. In one embodiment, the shore hardness is in the range of 50 to 100 duro meter, and in a particular embodiment, is 60-80 duro meter. In another set of embodiments, the tip 10 is formed from a combination of materials that provide support, allow flexibility during the gait of the user, and absorb shock.

Figure 3:
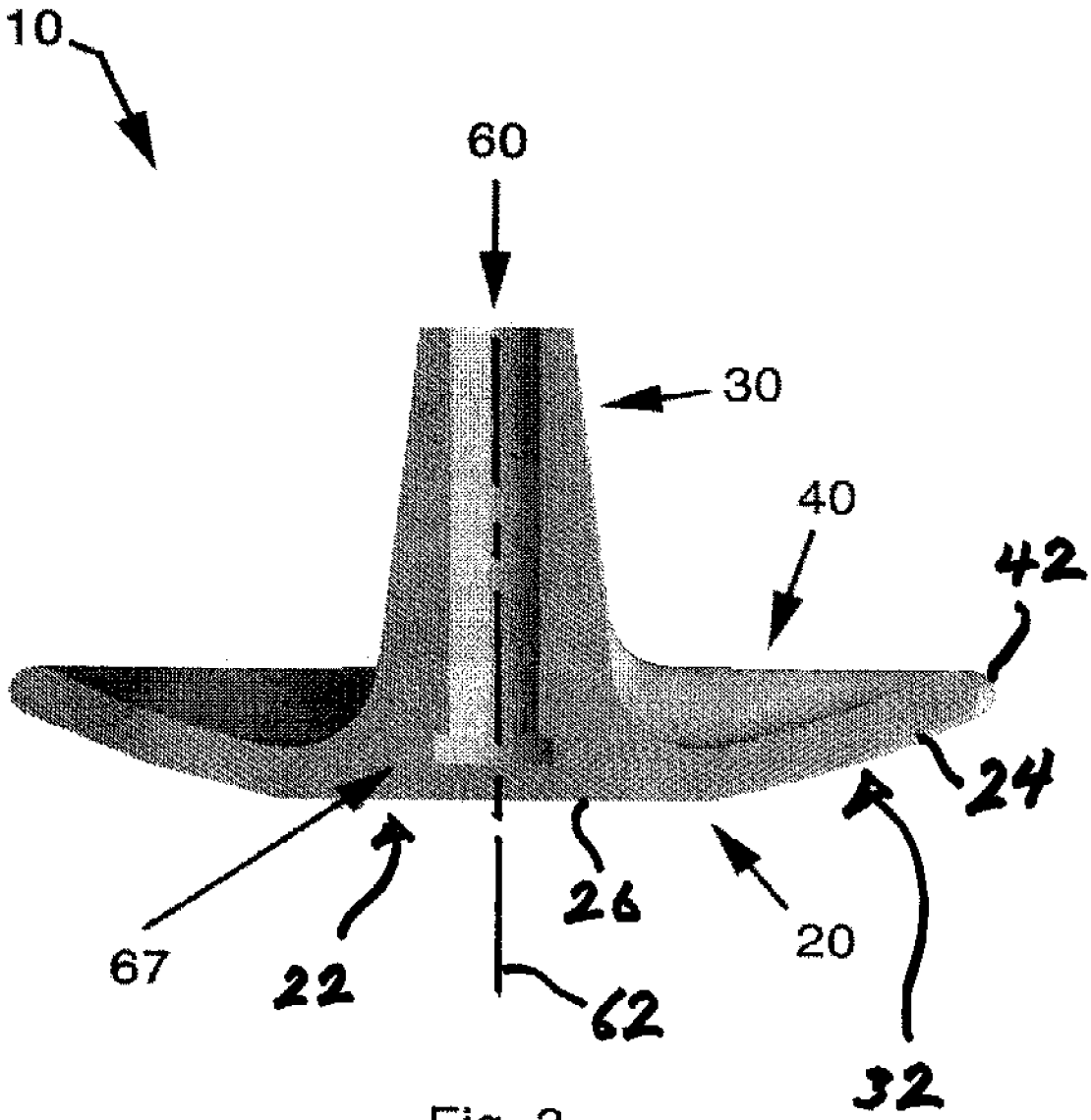
FIG. 3 is a cross sectional side view of another embodiment of a tip in accordance with an aspect of the present invention.

The outer (bottom) surface 32 of the base member 20 has a degree of curvature, which as well as the outer rim 42, further provides stability to the tip 10 when the user moves a walking aid configured with the tip 10 over uneven surfaces or surfaces, such as sand and gravel. The curved bottom surface 32 further provides stability during every part of the user's gait as well as provides for a smoother gait. A curve segment defined by the intersection of the outer surface 32 and a plane including the central axis of the tip 10 is a continuous curve segment without an inflection point over the whole length of the curve segment. Alternatively, the base member 20 may have a relatively flat bottom surface, with the outer surface 32 including a relatively flat portion 22 as illustrated in FIG. 3. In this alternative, a curve segment defined by the intersection of the outer surface 32 and a plane including the central axis 62 of the tip has a convex segment 24 extending from the outer rim 42 toward the central axis 62 and a linear segment 26 extending from the convex segment 24 to the central axis 62, with the linear segment 26 being substantially perpendicular to the central axis 62 to form the relatively flat portion 22 on the outer surface 32.

Figure 2:
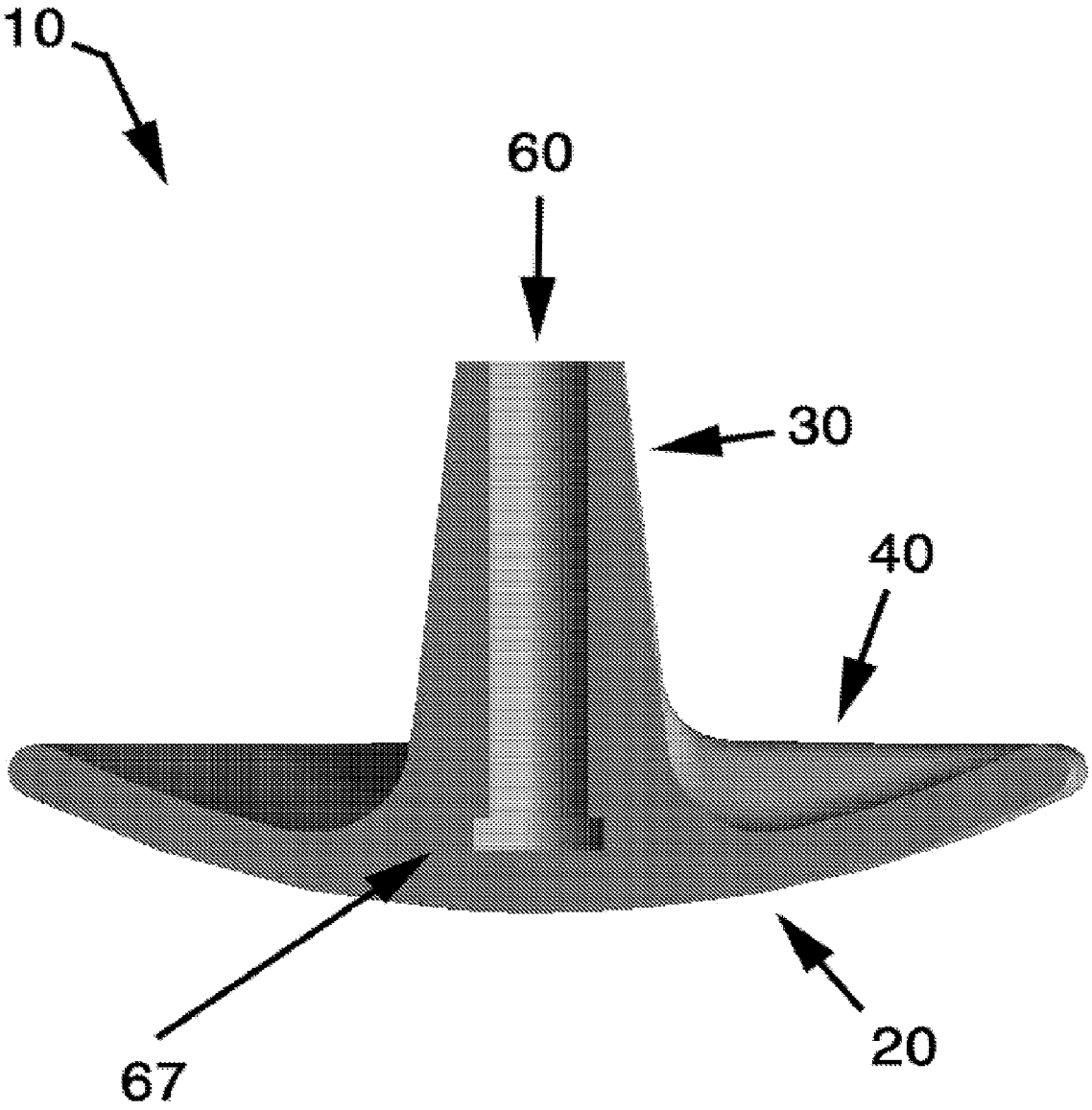
FIG. 2 is a cross sectional side view of an embodiment of a tip in accordance with an aspect of the present invention.

Referring to FIG. 2, the tip 10, is shown as including a disk 67 within interior of the tip 10. As shown, the disk 67 is located between an end of the bore 60 and the inner surface 40 of the base member 20. In one embodiment, the disk 67 has a diameter that is larger than the inner diameter of the bore 60. In particular embodiments, the diameter of the bore 60 may be between 0.75 and 1.5 inches. The disk 67 may be formed from any suitable rigid material such as, but not limited to, metal.

The tips as described may be of any suitable size depending on their intended usage. In one embodiment, the tips are configured for smaller users such as children. All the measurements could be 50% smaller for this set of embodiments than a normal sized tip.

In addition, it is contemplated that the total weight and degree of flexibility may be varied depending on the intended use of the tip. For example, for athletes training in the sand, it may be desirable to make the tips even lighter and more flexible than tips intended for use on pavement and relatively even surfaces.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims

The invention claimed is:

1. A tip configured for removable attachment to a walking aid device comprising:

a base member having an inner surface, an outer surface, and an outer rim between the inner surface and the outer surface, the outer rim being circular and defining a horizontal plane;

a shaft projecting from the inner surface and being radially symmetric about a central axis of the tip, the shaft defining a bore operable to receive and retain the walking aid device, the bore having an open end opposite the inner surface; and a plurality of spaced apart ribs projecting from the inner surface, each of the plurality of spaced apart ribs extending radially from the outer rim to the shaft, each of the plurality of spaced apart ribs having a top edge away from the inner surface, and each of the top edges lying substantially in the horizontal plane;

wherein the inner surface is concave facing toward the shaft;

the outer surface includes a relatively flat portion; and a radially symmetric curve segment is defined by any intersection of the outer surface and a plane including the central axis, the curve segment having a convex segment and a linear segment, the convex segment extending from the outer rim toward the central axis, and the linear segment extending from the convex segment to the central axis, the linear segment being substantially perpendicular to the central axis to form the relatively flat portion on the outer surface.

2. The tip of claim 1, wherein the base member, the shaft, and the plurality of spaced apart ribs are flexible; and the plurality of spaced apart ribs are configured to flex in response to a downward compressive force on the shaft.

3. The tip of claim 1, wherein all of the base member, the shaft, and the plurality of spaced apart ribs are flexible, comprise a rubber material, and are one continuous piece.

4. The tip of claim 1, wherein the outer rim has a rounded edge.

5. The tip of claim 1, wherein the base member comprises a rubber material.

6. The tip of claim 5, wherein the rubber material has a Shore hardness in the range of 50 to 100 durometer.

7. The tip of claim 5, wherein the rubber material has a Shore hardness in the range of 60 to 80 durometer.

8. The tip of claim 1, wherein the shaft has a bottom end near the inner surface and a top end opposite the bottom end, and the shaft increases in outer diameter from the top end to the bottom end.

9. The tip of claim 1, wherein the base member, the shaft, and the plurality of spaced apart ribs are one continuous piece.

10. The tip of claim 1, wherein the outer surface is smooth.

11. The tip of claim 1, wherein the bore has a closed end opposite the open end, the tip further comprising a rigid disk disposed within the bore at the closed end.

12. A walking aid device comprising the tip of claim 1.

* * * * *